US007905525B2

(12) United States Patent
Badia

(10) Patent No.: US 7,905,525 B2
(45) Date of Patent: Mar. 15, 2011

(54) SECURITY LATCH DEVICE WITH A LATCHING ARM COVER

(76) Inventor: James Badia, Myrtle Beach, SC (US)

( * ) Notice: Subject to any disclaimer, the term of this patent is extended or adjusted under 35 U.S.C. 154(b) by 0 days.

(21) Appl. No.: 12/383,236

(22) Filed: Mar. 20, 2009

(65) Prior Publication Data

US 2010/0156121 A1 Jun. 24, 2010

Related U.S. Application Data

(60) Provisional application No. 61/203,249, filed on Dec. 19, 2008.

(51) Int. Cl.
*E05C 17/04* (2006.01)
*E05C 17/00* (2006.01)

(52) U.S. Cl. ..... 292/262; 292/268; 292/DIG. 15; 292/DIG. 38; 292/DIG. 56; 292/DIG. 73; 16/82

(58) Field of Classification Search ..... 292/137, 292/146, 150, 262, 268, DIG. 38, DIG. 56, 292/DIG. 57, DIG. 59, DIG. 73, DIG. 15; 16/82

See application file for complete search history.

(56) References Cited

U.S. PATENT DOCUMENTS 372,326 A * 11/1887 Palmenberg ..... 292/268
1,194,636 A * 8/1916 Joy ..... 292/163
1,250,959 A * 12/1917 Brown ..... 428/99
1,290,133 A * 1/1919 Dusseau ..... 292/202
1,620,414 A * 3/1927 Vanderlip ..... 292/101
1,653,553 A * 12/1927 Edelmann ..... 292/175
2,151,587 A * 3/1939 Cassileth ..... 292/288
2,692,157 A * 10/1954 Soderberg ..... 292/288
3,306,643 A * 2/1967 Reed ..... 292/1
4,082,351 A * 4/1978 Chrones ..... 292/347
4,357,039 A * 11/1982 Tolle ..... 292/341.12
4,756,564 A * 7/1988 Ikeda ..... 292/216
4,877,277 A * 10/1989 Leopoldi ..... 292/347
4,896,908 A * 1/1990 Kleefeldt ..... 292/216
D345,091 S * 3/1994 Malone ..... D8/331
6,048,005 A * 4/2000 Rotondi ..... 292/262
7,380,846 B1 * 6/2008 Moreno ..... 292/259 R
2006/0006678 A1 * 1/2006 Herron ..... 292/336.3
2007/0040392 A1 * 2/2007 Matsuki ..... 292/262

* cited by examiner

*Primary Examiner* — Carlos Lugo

(74) *Attorney, Agent, or Firm* — Heidi Faivre; Bambi Faivre Walters

(57) ABSTRACT

Exemplary embodiments of a security latch device comprises a security latching arm configured to move, pivot, swing or slide from a operative position, non-operative position or door-ajaring position and a security latching arm cover. The cover comprises a sleeve configured to conform to the security latching arm and to slip on or install on, over or around the security latching arm and being made of impact absorbing material to protect an impacted surface (e.g., a door's surface, door frame or door jamb) when the security latching arm is impacted by a door.

7 Claims, 7 Drawing Sheets

SECURITY LATCH DEVICE WITH A LATCHING ARM COVER

CROSS REFERENCE TO RELATED APPLICATION

This application claims the benefit of U.S. Provisional Application No. 61/203,249 filed on Dec. 19, 2008, and of which is incorporated herein by reference in its entirety.

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND

I. Field

The invention relates to covers for security latch devices.

II. Background

For security, hotel rooms are equipped with automatic door locks with electronic key access, dead bolts and security latch devices or door guards. The security latch devices are provided for the added protection of the room occupant of the hotel when in the room and, especially, when the resident is sleeping or does not want to be disturbed. A security latch device includes a security latching arm. When the security latching arm is deployed, as intended, the door is allowed to be swung open only partially from the inside to allow the occupant to observe who is at the door, without allowing full access into the room. However, the security latching arm is oftentimes used to intentionally keep the hotel door ajar (so that the door is prevented from automatically closing and locking). For example, the latching arm may be deployed to keep the door ajar for a quick run to the ice machine, to a vending machine in a nearby room, to dash out and grab some food off of a breakfast bar, to hang out in the hallway with other hotel occupants, and for other reasons. The security latching arm may be used to keep the hotel door ajar for many other reasons such as, without limitation, to ask a close-by housekeeper for additional towels.

When the security latching arm is used to keep the door ajar, the arm (e.g., swing latching arm or bar-type latching arm) of the security latch device is pivoted, swung, slid or moved to interpose the security latching arm between the door and the door jamb. The occupant sometimes quickly releases the hotel door after the security latching arm is interposed between the door and the door jamb. Consequently, the hotel door, which may be biased to automatically close, strikes or slams into the security latching arm; thereby, banging the door, the latching arm and the door jamb (or door frame).

The security latch device is typically made of metal or other heavy and rigid material. Hence, the paint and surfaces on the door, door jamb and/or door frame may be chipped, scratched, marked and/or dented upon impact with the security latching arm. Accordingly, the doors and door frames need repeated maintenance from, as little as, refreshing paint to the removal of the door and/or door frame. Thus, the security latch is a source of repeated maintenance and cost.

In general, the security latch device may be a swing arm security latch, a bar-type locking mechanism or a like security latch device, such as those known by the following terms—"privacy flip lock"; "hotel security latch"; "swing bar security latch"; "bar lock"; "pivoting swing latch"; "door guard"; "security door latch"; "safety latch"; "swing bar guard mechanism"; and "door retainer"—all of which are made by various manufacturers.

SUMMARY

The aforementioned problems and other problems, are reduced, according to exemplary embodiments, by the devices and methods for protecting doors, door jambs or door frames from a security latching arm interposed between the door and door jamb or door frame.

According to an exemplary embodiment, the security latching arm cover comprises a sleeve configured to conform to a security latching arm of a security latch device. The sleeve is slipped on or installed on, over or around the security latching arm. The sleeve is made of impact absorbing material to protect a door's surface, door jamb and/or door frame when the security latching arm is impacted by a door.

According to another exemplary embodiment, the security latch device comprises a security latching arm configured to move, pivot, swing or slide from an operative position, non-operative position or door-ajaring position and a security latching arm cover. The cover comprises a sleeve configured to conform to the security latching arm of the security latch device and to slip on or install on, over or around the security latching arm and being made of impact absorbing material to protect a door's surface, door jamb and doorframe when the security latching arm is impacted by a door.

Other systems, methods, and/or products according to embodiments will be or become apparent to one with skill in the art upon review of the following drawings and further description. It is intended that all such additional systems, methods, and/or products be included within this description, be within the scope of the present invention, and be protected by the accompanying claims.

BRIEF DESCRIPTION OF THE DRAWINGS

The above and other exemplary embodiments, objects, uses, advantages, and novel features are more clearly understood by reference to the following description taken in connection with the accompanying figures wherein.

The appended drawings illustrate exemplary configurations of the disclosure and, as such, should not be considered as limiting the scope of the disclosure that may admit to other equally effective configurations.

DESCRIPTION

The word "exemplary" is used herein to mean "serving as an example, instance, or illustration." Any configuration or design described herein as "exemplary" is not necessarily to be construed as preferred or advantageous over other configurations or designs.

This invention now will be described more fully hereinafter with reference to the accompanying drawings, in which exemplary embodiments are shown. This invention may, however, be embodied in many different forms and should not be construed as limited to the embodiments set forth herein. These embodiments are provided so that this disclosure will be thorough and complete and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or perspective views illustrating some of the devices, covers and methods embodying this invention. The functions of the various elements shown in the figures may be provided through the use of dedicated hardware as well as security latch device or bar-type latch device hardware that may vary in shape, attachment, size, and other physical features. Those of ordinary skill in the art further understand that the exemplary device hardware, systems, and/or methods described herein are for illustrative purposes and, thus, are not intended to be limited to any particular named manufacturer or other relevant physical limitation (e.g., color of the sleeve). Still further, those of ordinary skill in the art further understand that the security latch device may be utilized in the hotel industry, in the travel industry, for latching mechanisms on perimeter fences (e.g., swing open the latch to keep the gate from closing), and for residential purposes (e.g., ease of use of security latch device compared to using a key to unlock a deadbolt of the door).

Figure 1A:
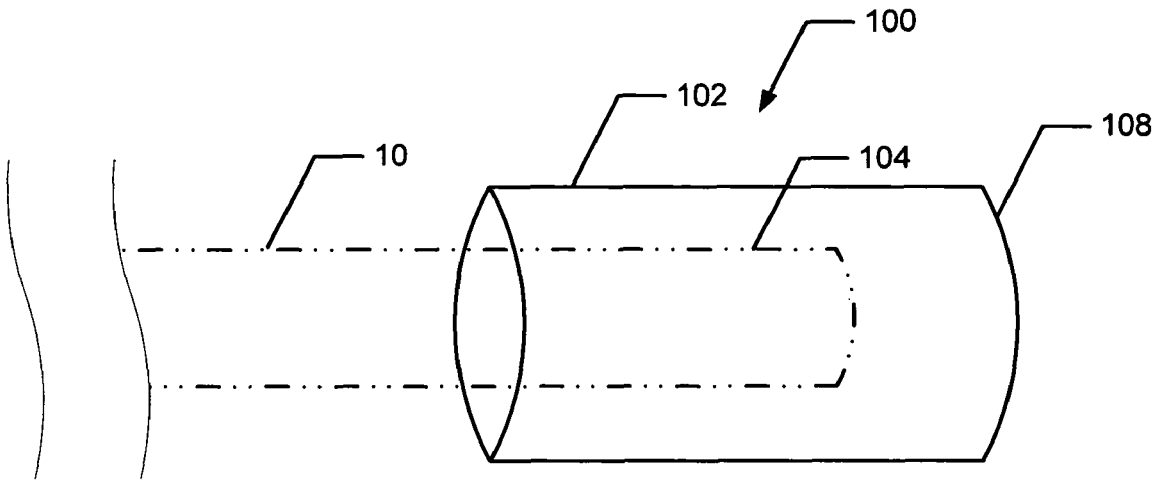
FIG. 1A illustrates a perspective view of a security latching arm cover with a partial view of a security latching arm (shown in phantom) in accordance with some of the exemplary embodiments.
Figure 1B:
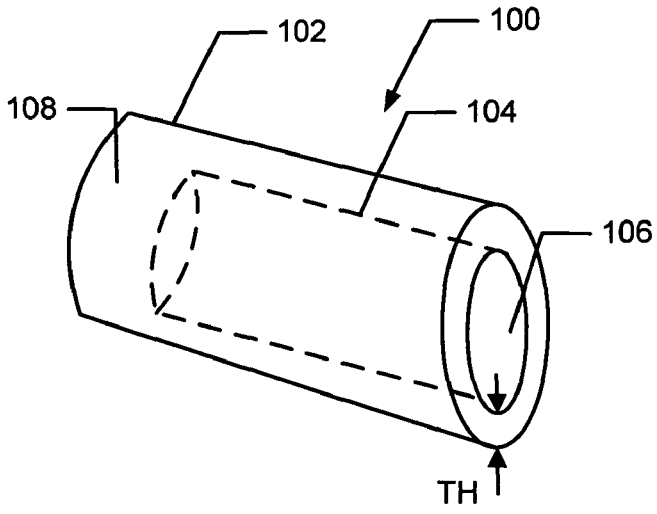
FIG. 1B illustrates a perspective view of a security latching arm cover in accordance with some of the exemplary embodiments.

FIG. 1A illustrates a perspective view of a security latching arm cover 100 with a partial view of a security latching arm 10 (shown in phantom). FIG. 1B illustrates the security latching arm cover 100 without the security latching arm 10. The security latching arm cover 100 is made of impact absorbing material such as rubber, resilient material, flexible plastic material, leather, other man-made products, natural products and combinations thereof. The security latching arm cover 100 comprises, in an embodiment, a cylindrically shape structure 102 with a hollow cavity 104 (shown in phantom) formed therein. The structure 102, in an embodiment, is unitary. One side of the cylindrically shaped structure 102 has an opening 106 formed therein. The opening 106 permits access therethrough by the security latching arm 10.

The cylindrically shaped structure 102 has a thickness TH corresponding to the wall thickness about the opening 106 and along the length of the hollow cavity 104. The other end 108 of the cylindrically shaped structure 102 is closed. The thickness of the cylindrically shaped structure 102 on the end 108 is the diameter of the cylindrical shaped structure 102. The cylindrically shaped structure 102 (sometimes referred to herein as a "sleeve") provides cushioning and impact absorption to dampen impact forces applied thereto, and consequently, damage to the door, door jamb and/or doorframe is minimized, if not prevented.

The security latching arm cover 100 is fitted around or to the contoured configuration of the security latching arm 10. The security latching arm cover 100 may be friction-fit coupled on, over or around security latching arm 10 so that, after installation, the security latching arm cover 100 remains secure and in position (installed).

More specifically, the cylindrically shaped structure 102 or sleeve of the security latching arm cover 100 is tightly fitted around or to the contoured configuration of the security latching arm 10 so that once the sleeve is installed, the latching arm cover 100 remains in place even after repeated grabbing, touching or manipulation of the latching arm cover 100. For example, the fitting of the cover 100 could adhere to the surface of the security latching arm 10 depending on shape and friction, or other means to effectuate attachment.

In an embodiment, the cylindrically shaped structure 102 or sleeve may be adhesively affixed to the security latching arm 10 so that the cylindrically shaped structure 102 or sleeve is not easily removed.

In an embodiment, the cylindrically shaped structure 102 or sleeve may be coated on or applied to the security latching arm 10 so that the cylindrically shaped structure 102 or sleeve remains in the installed position. For example, the sleeve may be comprised of a material that is applied to, painted on or otherwise formed directly onto the surface of the security latching arm 10, and the material or paint would form the security latching arm cover 100. For example, the sleeve may comprise foam that is painted, sprayed or coated on the security latching arm 10 which after a drying time, hardens, cures or sets to form the sleeve having impact absorption properties.

Figure 2A:
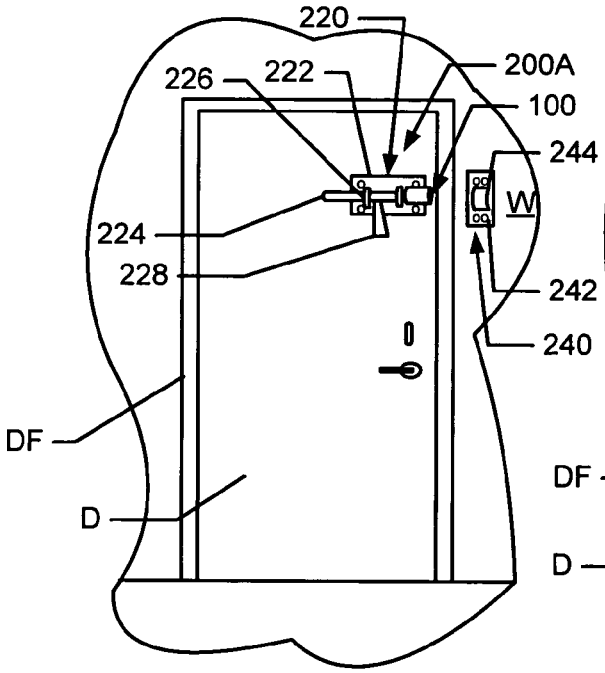
FIG. 2A illustrates a security latch device, in a non-operative position, installed on a hotel door and wall in accordance with some of the exemplary embodiments.

FIG. 2A illustrates a security latch device 200A, in a non-operative position, installed on a hotel door D and wall W. The hotel door D is shown closed and is viewed from the inside. The door frame DF includes right and left vertical jambs and top and bottom horizontal jambs. The door D is hingedly coupled to one of the vertical jambs. Nonetheless, the construction of the door D and door frame DF is very well known. Thus, no further discussion is provided. The reference label A, B or C after the number 200 is used to denote the different positions of the security latching arm 224 for the same security latch device. The security latching arm 224 is capable of being moved in other intermediary positions between the positions shown in FIGS. 2A-2B, 2A and 2C or 2B and 2C. Thus, the positions are exemplary and not intended to be limiting.

The security latch device 200A is a bar-type security latching assembly configuration. The device 200A includes a security latching arm assembly 220, installed on door D, and a latching slot assembly 240, installed on wall W. In another embodiment, the security latching arm assembly 220 may be installed on the wall W and the latching slot assembly 240 may be installed on the door. The security latching assembly 220 includes a mounting plate 222 with fasteners for attachment to the door D, a security latching arm 224 with security latching arm cover 100 inserted on, over or around a free-end of the security latching arm 224. The security latching assembly 220 is mounted to the door D in proximity to a vertical edge of the door opposite the vertical edge of the door that is hinged to the doorjamb.

The security latching assembly 220 further includes at least one strap or clip 226 for securing the security latching arm 224 to the mounting plate 222. The at least one strap or clip 226 slideably receives the security latching arm 224 therein so that the security latching arm 224 can be slid from and to a non-operative position (FIG. 2A), an operative position (FIG. 2B) and/or the door-ajaring position (FIG. 2C). The security latching assembly 220 further comprises an actuating handle 228 affixed to the security latching arm 224. The actuating handle 228 is configured to be grasped by a user's hands. The actuating handle 228 allows the user to grasp the actuating handle 228 and selectively slide or move the security latching arm 224. The security latching arm 224 can be selectively slid from and to the non-operative position (FIG. 2A), the operative position (FIG. 2B) and/or the door-ajaring position (FIG. 2C).

In an embodiment, there is a pair of straps or clips 226 affixed, bolted or secured to the mounting plate 222. When the actuating handle 228 is positioned between the pair of straps 226. The distance slid or traveled by the security latching arm 224 is limited by the distance between pair of straps or clips 226. In an embodiment, the pair of straps or clips 226 may be affixed, bolted or secured directly to the door D or, alternately, wall W, without the need for a mounting plate.

In the exemplary illustration, the non-operative position corresponds to the security latching arm 224 being in a non-deployed state or fully retracted state, as best seen in FIG. 2A. The latching slot assembly 240, installed on wall W, includes a mounting plate 242 having affixed, secured or fastened thereto a latching slot 244. The latching slot 244 is dimensioned to receive the free-end of the security latching arm 224 with the security latching arm cover 100 when the free-end of the security latching arm 224 is injected (by sliding motion) into the latching slot 244.

Figure 2B:
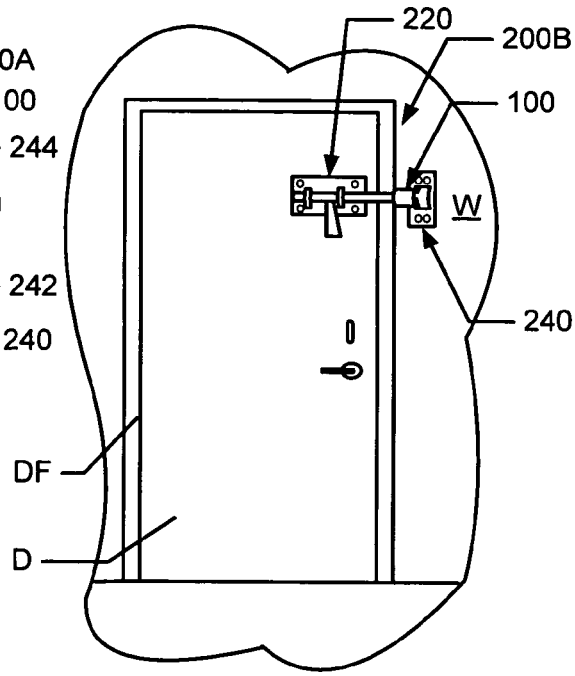
FIG. 2B illustrates the security latch device, in an operative position, installed on a hotel door and wall in accordance with some of the exemplary embodiments.
Figure 2C:
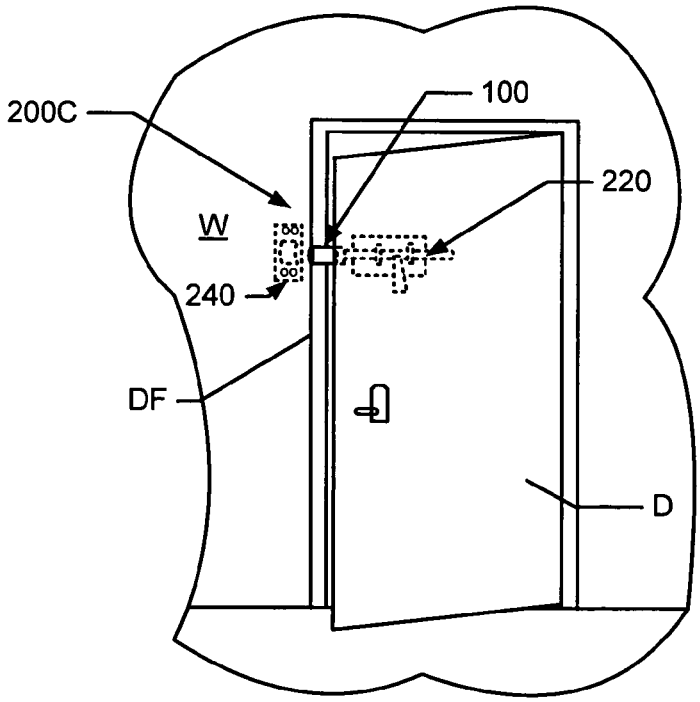
FIG. 2C illustrates the security latch device, in a door-ajaring operative position, installed on a hotel door and wall in accordance with some of the exemplary embodiments.

FIG. 2B illustrates the security latch device 200B, in an operative position, installed on the hotel door D and wall W. The hotel door D is shown closed and is viewed from the inside. In the illustration, the operative position corresponds to the security latching arm 224 being in the deployed state or injected and secured in the latching slot 244, as best seen in FIG. 2B.

The security latching arm cover 100 can be used with existing security latch devices (e.g., existing bar-type security latch devices). The existing bar-type security latch devices would require minimal retrofitting. For example, the latching slot assembly (e.g., latching slot assembly 240) may require replacement if the latching slot does not have an opening sufficiently large to pass the diameter of the security latching arm cover 100 therethrough when in the security latching arm with cover 100 is in the deployed state.

FIG. 2C illustrates the security latch device 200C, in a door-ajaring operative position, installed on the hotel door D and wall W. In the exemplary illustration, the hotel door D is shown ajar and is being viewed from the outside. Thus, the security latch device 200C is shown, in phantom, except that portion of the latching arm cover 100 viewable from the outside when the security latching arm 224 is in the door-ajaring operative position. In the in door-ajaring position, the latching arm cover 100 is interposed between the hotel door D and the door frame DF or door jamb. Thereby, the impact-dampening construction of the security latching cover 100 buffers impacts or strikes departed to the hotel door D and the door frame DF or door jamb, such as when the door D is left to freely close or when the door slams.

Figure 3:
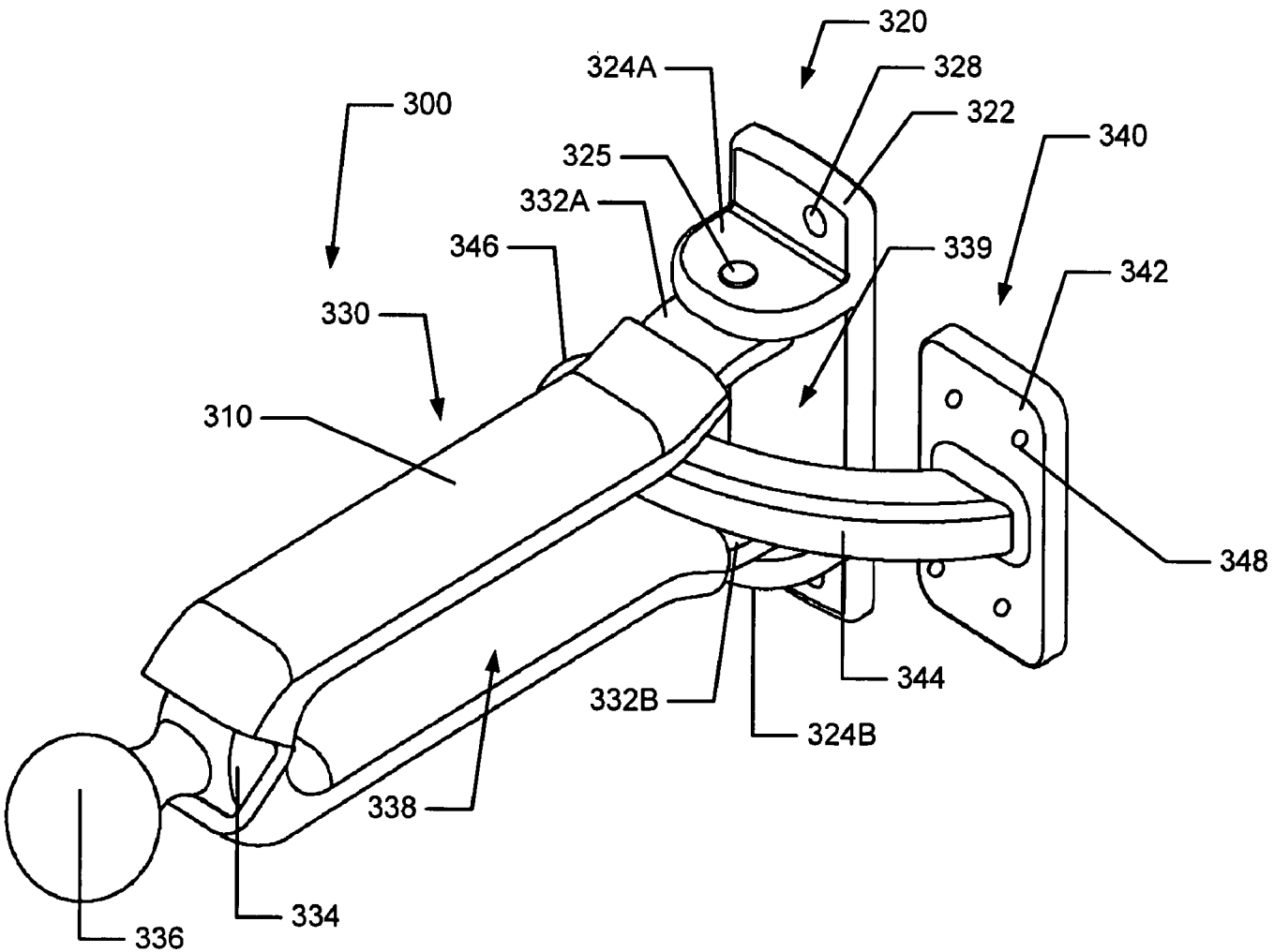
FIG. 3 illustrates a perspective view of another security latch device, in an operative position, in accordance with some of the exemplary embodiments.

FIG. 3 illustrates a perspective view of another security latch device 300, in an operative position. The security latch device 300 has a ball hook and yoke style security latching assembly configuration. The security latch device 300 includes a U-shaped latching assembly 320 which, in an embodiment, includes a mounting plate 322 and a pivoting U-shaped latching arm 330. The mounting plate 322 is fastened via fasteners 328 to a wall in proximity to the vertical door jamb opposite the vertical door jamb to which the door is hinged. The pivoting U-shaped latching arm 330 is hingedly or swingingly mounted to the mounting plate 322 via hinge members 324A and 324B. The pivoting U-shaped latching arm 330 serves as a yoke.

The pivoting U-shaped latching arm 330 has a U-shape or horse-shoe shape configuration. The U-shape, in an embodiment, is made of a continuous piece of metal or other durable, rigid and strong material that has a bend or arch generally in a middle or at apex 334. The U-shape includes first and second parallel legs 332A and 332B which are separated by a predetermined distance to form a slide channel 338. At the apex 334, the pivoting U-shaped latching arm 330 includes a ball or spherically-shaped tip 336 integrally affixed to, formed on or molded along an exterior surface of the bend or arch. The ball or spherically-shaped tip provides a reinforced end with additional ease of manipulation or placement of the latching arm 330 as well as other advantages. The free ends of legs 332A and 332B are hingedly or swingingly coupled to hinge members 324A and 324B via pivot pins 325.

The security latch device 300 further includes a ball hook assembly 340 mounted to the door in proximity to a vertical edge of the door opposite to the vertical edge of the door hinged to the door jamb. The ball hook assembly 340 is positioned to mate or yoke with the pivoting U-shaped latching arm 330 in the slide channel 338.

The ball hook assembly 340 includes a hook mounting plate 342 having a curved finger or prong member 344 mounted thereto. The ball hook assembly 340 further includes a ball or spherically-shaped tip 346 integrally affixed to or formed on a free end of the curved finger or prong member 344. The hook mounting plate 342 includes fasteners 348 for attachment to the door on the side intended to be swung open. The hook mounting plate 342 is intended to be installed at a location proximate to an edge of the door intended to be swung open.

The free-ends of the legs 332A and 332B are slightly flared in an outward direction. The flaring configuration slightly widens the slide channel 338 in proximity to the hinge members 324A and 324B to form a receiving hole 339 between and in proximity to the hinge members 324A and 324B. The receiving hole 339 is dimensioned to receive the diameter or circumference of the ball or spherically-shaped tip 346. The width of the slide channel 338 is smaller than the diameter or circumference of the ball or spherically-shaped tip 346 and serves as a locking portion or locking mechanism.

In operation, security latch device 300 allows the door to be swung open approximately a distance that corresponds to the length of the slide channel 338. The receiving hole 339 of the pivoting U-shaped latching arm 330 serves as an unlocking portion of the U-shaped latching arm 330. The narrower configuration or width of the slide channel 338 serves as a locking portion of the pivoting U-shaped latching arm 330.

When the pivoting U-shaped latching arm 330 is in a latching position, if the door is swung open, the curved finger or prong member 344 of the ball hook assembly 340 slides from the receiving hole 339 and along the slide channel 338. When the curved finger or prong member 344 reaches the end of the slide channel 338 in proximity to apex 334, the door is prevented from being swung any further. The narrower configuration of the slide channel 338 prevents the ball or spherically-shaped tip 346 from passing through the slide channel 338 when in proximity to apex 334.

The security latch device 300 further includes a security latching arm cover 310. The security latching arm cover 310 provides cushioning and impact absorption to dampen impact forces applied thereto. The security latching arm cover 310 is fitted around or to the contoured configuration of the U-shaped latching arm 330. The latching arm cover 310 may be friction-fit coupled on, over or around U-shaped latching arm 330 so that, after installation, the latching arm cover 310 remains secure and in position (installed).

More specifically, the security latching arm cover 310 is tightly fitted around or to the contoured configuration of the U-shaped latching arm 330 so that once installed, the latching arm cover 310 remains in place even after repeated grabbing, touching or manipulation of the latching arm cover 310.

In an embodiment, the security latching arm cover 310 may be adhesively affixed to the U-shaped latching arm 330 so that the security latching arm cover 310 is not easily removed.

In an embodiment, the security latching arm cover 310 may be coated on or applied to the U-shaped latching arm 330 so that the security latching arm cover 310 remains in the installed position. Furthermore, the security latching arm cover 310 may be transparent or opaque. The security latching arm cover 310 is a unitary structure and is made of sponge rubber, rubber, resilient and flexible plastic material, leather or other impact absorbing material including natural and man-made materials.

Figure 4B:
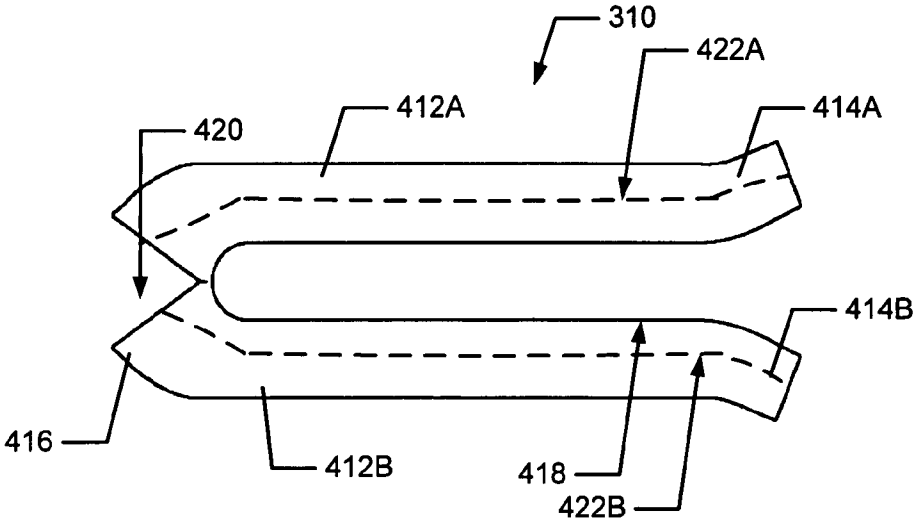
FIG. 4B illustrates a side view of a security latching arm cover of FIG. 4A.
Figure 4A:
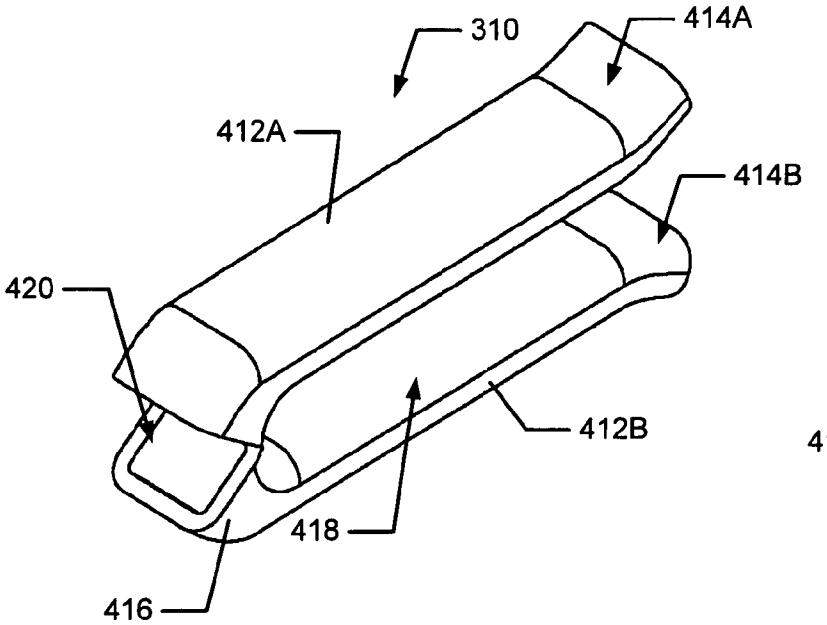
FIG. 4A illustrates a perspective view of a security latching arm cover for the security latch device of FIG. 3 in accordance with some of the exemplary embodiments.

The configuration and construction of the security latching arm cover 310 will now be described in relation to FIGS. 4A and 4B. FIG. 4A illustrates a perspective view of a latching arm cover for the security latch device of FIG. 3 or other existing security latch devices already installed. The security latching arm cover 310 has a generally U-shaped configuration that tracks the contour of the U-shaped latching arm 330 and includes a V-shaped notch 420 formed in proximity to an arched-end or apex portion 416. The V-shaped notch 420 is configured to receive and pass therethrough the ball or spherically-shaped tip 336, as best seen in FIG. 3.

The security latching arm cover 310 includes parallel sleeve portions 412A and 412B which are dimensioned to cover, wrap, and enclose the parallel legs 332A and 332B. Free ends portions 414A and 414B of the sleeve portions 412A and 412B, respectively, are slightly flared in an outward direction and track the outward flaring of the free ends of the parallel legs 332A and 332B, respectively. The sleeve portions 412A and 412B are generally tubular in shape such that there is a hollow interior.

An interior surface 418 of the parallel sleeve portions 412A and 412B that is within the slide channel 338 is continuous from a tip of the free-end portion 414A to the tip of free-end portion 414B. The widest part of the V-shaped notch 420 is formed in an exterior surface of the arched-end or apex section 416. In an embodiment, the interior surface 418 may be smooth or frictionless so that the curved finger or prong member 344 can slide within the slide channel 338.

The security latching arm cover 310 may further comprise slits 422A and 422B formed longitudinally along a length of the sleeve portions 412A and 412B, respectively, and free-end portions 414A and 414B, respectively, to create openable seams to install the security latching arm cover 310 over and around the U-shaped latching arm 330. The slits 422A and 422B are configured to close or seal. In an embodiment, the resiliency and flexibility of the cover 310 would cause the slits to close by contraction of the material.

In an embodiment, in lieu of a unitary cover construction, the sleeve portions 412A and 412B with free-end portions 414A and 414B, respectively may be separated where the V-shaped notch 420 is formed so that the cover construction includes two sleeve portions. The two sleeve portions may optionally include the slits 422A and 422B.

The slits 422A and 422B allow the cover 310 to be wrapped or clamped around the first and second parallel legs 332A and 332B. The seams of the slits 422A and 422B may be configured to adhesively close and secure. In an embodiment, the slits 422A and 422B may close by contraction of the material. In an embodiment, the slits 422A and 422B may produce a gap of varying sizes.

Figure 5:
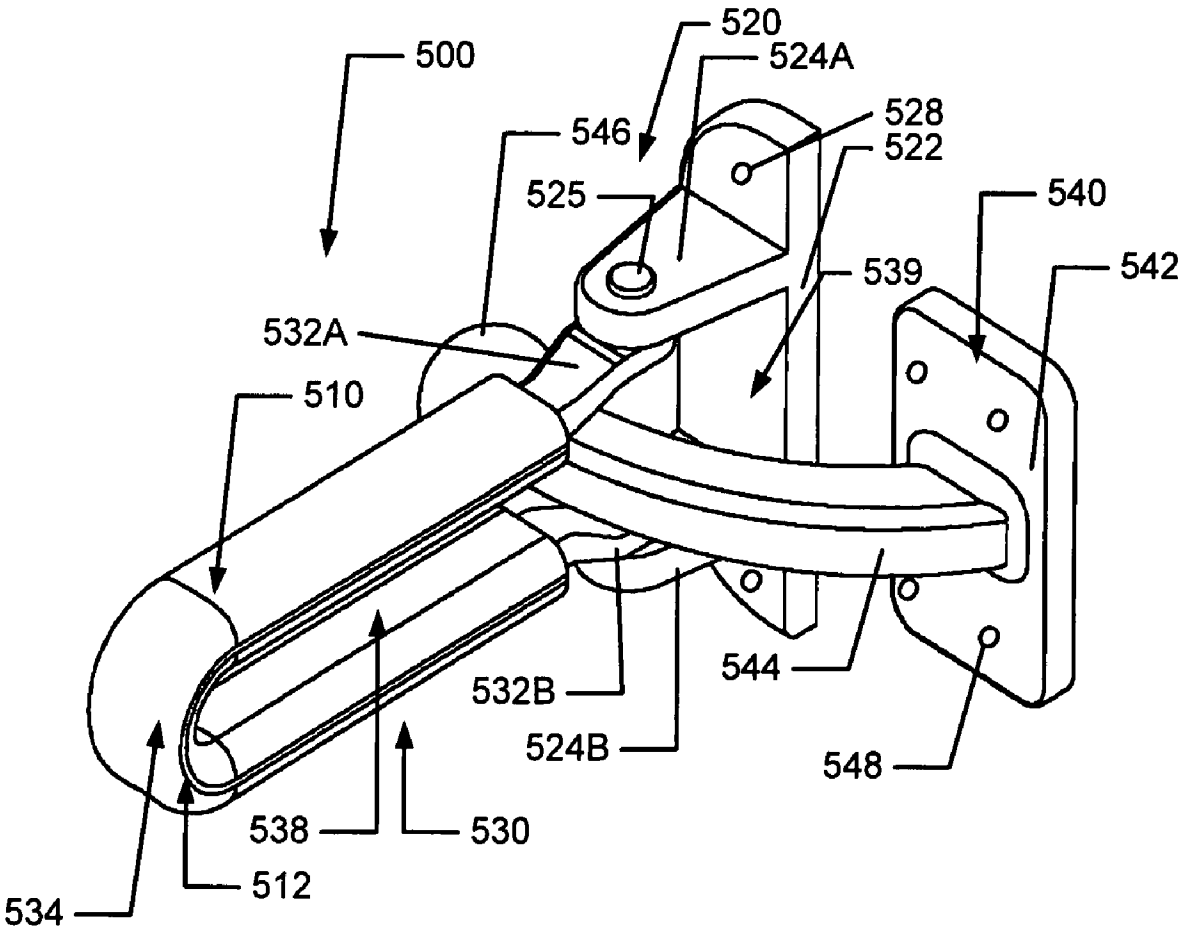
FIG. 5 illustrates a perspective view of yet another security latch device, in an operative position, in accordance with some of the exemplary embodiments.

FIG. 5 illustrates a perspective view of yet another security latch device 500, in an operative position. The security latch device 500 is another example of a ball hook and yoke style security latching assembly configuration. The security latch device 500 includes a U-shaped latching assembly 520 which, in an embodiment, includes a mounting plate 522 and a pivoting U-shaped latching arm 530. The mounting plate 522 is fastened via fasteners 528 to a wall in proximity to the vertical door jamb opposite the vertical door jamb to which the door is hinged. The pivoting U-shaped latching arm 530 is hingedly or swingingly mounted to the mounting plate 522 via hinge members 524A and 524B. The pivoting U-shaped latching arm 530 serves as a yoke.

The pivoting U-shaped latching arm 530 has a U-shape or horse-shoe configuration. The U-shape, in an embodiment, is made of a continuous piece of metal or other durable, rigid and strong material that has a bend or arch generally in a middle or at an apex 534. The U-shape includes first and second parallel legs 532A and 532B which are separated by a predetermined distance to form a slide channel 538. The free ends of legs 532A and 532B are hingedly or swingingly coupled to hinge members 524A and 524B via pivot pins 525.

The security latch device 500 further includes a ball hook assembly 540 mounted to the door in proximity to a vertical edge of the door opposite to the vertical edge of the door hinged to the door jamb. The ball hook assembly 540 is positioned to mate or yoke with the pivoting U-shaped latching arm 530 in the slide channel 538.

The ball hook assembly 540 includes a hook mounting plate 542 having a curved finger or prong member 544 mounted thereto. The ball hook assembly 540 further includes a ball or spherically-shaped tip 546 integrally affixed to or formed on a free end of the curved finger or prong member 544. The hook mounting plate 542 includes fasteners 548 for attachment to the door on the side intended to be swung open. The hook mounting plate 542 is intended to be installed at a location proximate to an edge of the door intended to be swung open.

The free-ends of the legs 532A and 532B are slightly flared in an outward direction. The flaring configuration slightly widens the slide channel 538 in proximity to the hinge members 524A and 524B to form a receiving hole 539 between and in proximity to the hinge members 524A and 524B. The receiving hole 539 is dimensioned to receive the diameter or circumference of the ball or spherically-shaped tip 546. The width of the slide channel 538 is smaller than the diameter or circumference of the ball or spherically-shaped tip 546 and serves as a locking portion or locking mechanism.

The security latch device 500 further includes a security latching arm cover 510. The security latching arm cover 510 provides cushioning and impact absorption to dampen impact forces applied thereto. The security latching arm cover 510 is fitted around or to the contoured configuration of the U-shaped latching arm 530. The latching arm cover 510 may be friction-fit coupled on, over or around U-shaped latching arm 530 so that, after installation, the latching arm cover 510 remains secure and in position (installed).

More specifically, the security latching arm cover 510 is tightly fitted around or to the contoured configuration of the U-shaped latching arm 530 so that once installed, the latching arm cover 510 remains in place even after repeated grabbing, touching or manipulation of the latching arm cover 510.

In an embodiment, the security latching arm cover 510 may be adhesively affixed to the U-shaped latching arm 530 so that the security latching arm cover 510 is not easily removed.

In an embodiment, the security latching arm cover 510 may be coated on or applied to the U-shaped latching arm 530 so that the security latching arm cover 510 remains in the installed position. Furthermore, the security latching arm cover 510 may be transparent or opaque. The security latching arm cover 510, in an embodiment, is a unitary structure and is made of sponge rubber, rubber, resilient and flexible plastic material or other impact absorbing material (natural, man-made or combination thereof). The security latching arm cover 510 has a U-shaped slit 512.

The slit 512 allows the cover 510 to be wrapped or clamped around the U-shaped latching arm 530 including legs 532A and 532B. The seam of the slit 512 may be configured to adhesively close and secure. In an embodiment, the slit 512 may close by contraction of the material. In an embodiment, the slit 512 may produce a gap of varying sizes.

The configuration and construction of the security latching arm cover 510 will now be described in relation to FIGS. 6A and 6B. FIG. 6A illustrates a perspective view of a security latching arm cover for the security latch device of FIG. 5 or existing security latch devices of similar kind. The security latching arm cover 510 has a generally U-shaped configuration that tracks the contour of the U-shaped latching arm 530.

The security latching arm cover 510 includes parallel sleeve portions 612A and 612B which are dimensioned to cover, wrap, and enclose the parallel legs 532A and 532B. The sleeve portions 612A and 612B are generally tubular in shape such that there is a hollow interior. The parallel sleeve portions 612A and 612B are joined by an arch portion 614. The parallel sleeve portions 612A and 612B and arch portion 614 create a U-shaped hollow cavity to receive the U-shaped latching arm 530.

Figure 6B:
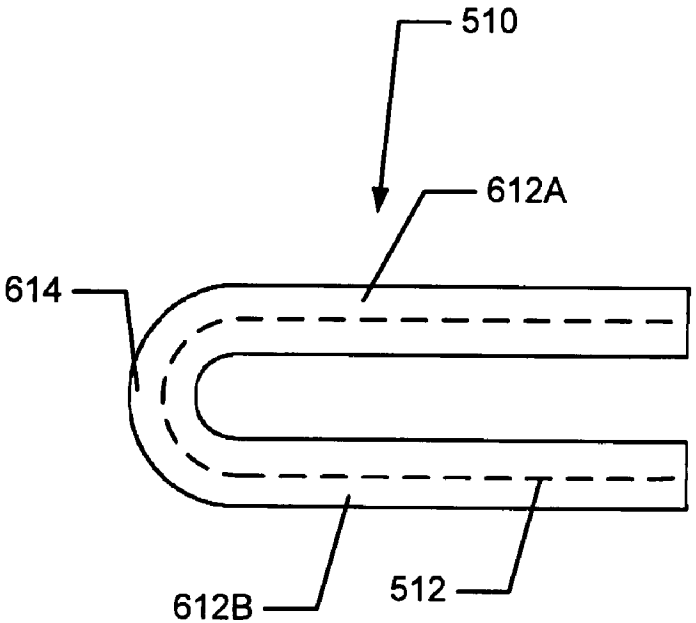
FIG. 6B illustrates a side view of a security latching arm cover of FIG. 6A.
Figure 6A:
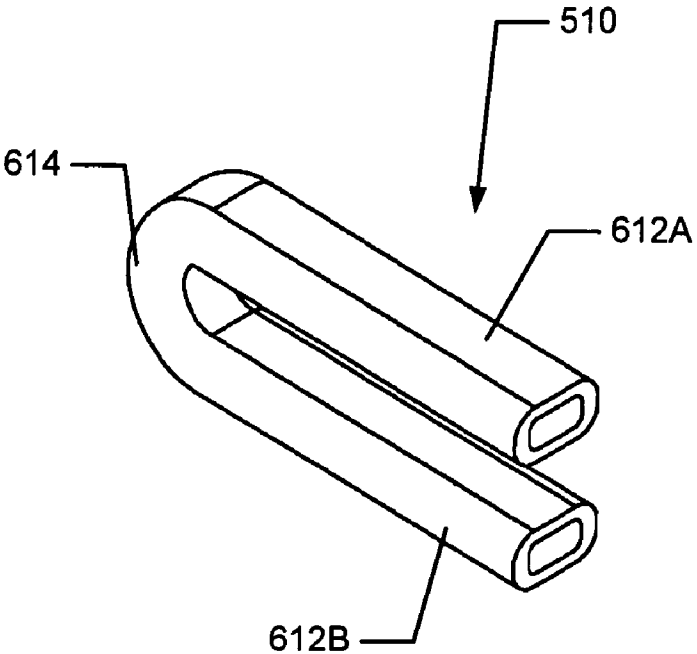
FIG. 6A illustrates a perspective view of a security latching arm cover for the security latch device of FIG. 5.

The security latching arm cover 510 is shown with slit 512 represented as a dashed line in FIG. 6B.

Figure 7A:
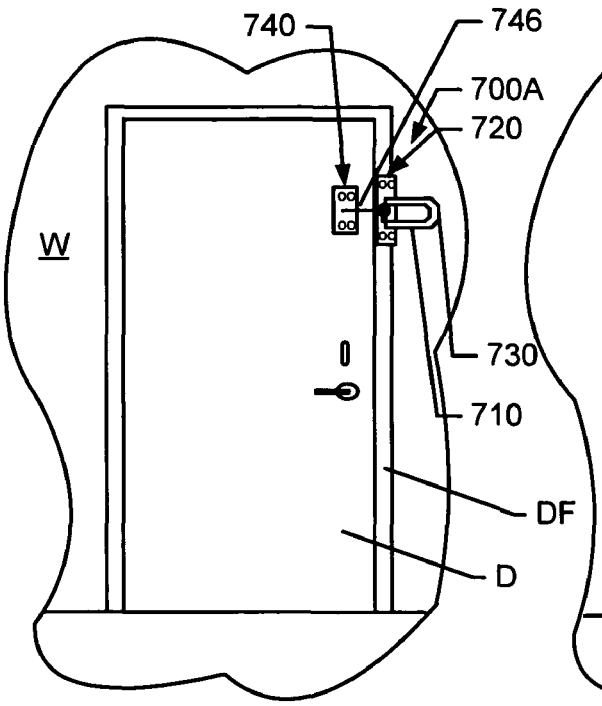
FIG. 7A illustrates a security latch device, in a non-operative position, installed on a hotel door and wall in accordance with some of the exemplary embodiments.
Figure 7B:
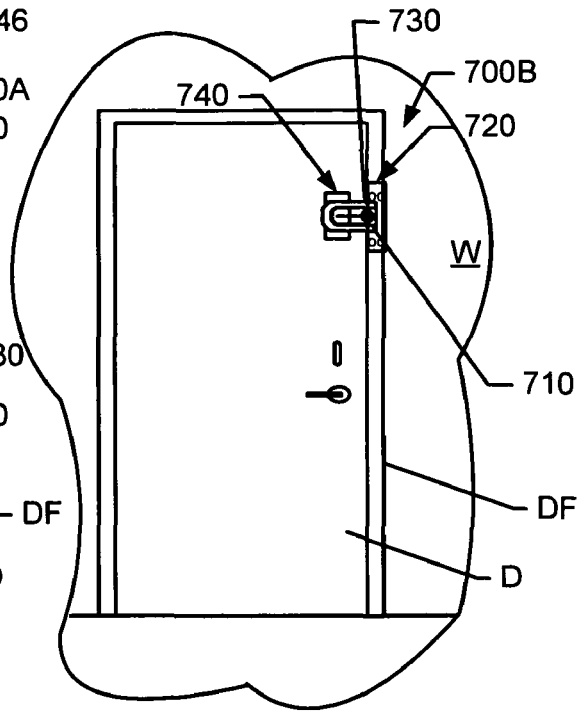
FIG. 7B illustrates the security latch device, in an operative position, installed on a hotel door and wall in accordance with some of the exemplary embodiments.
Figure 7C:
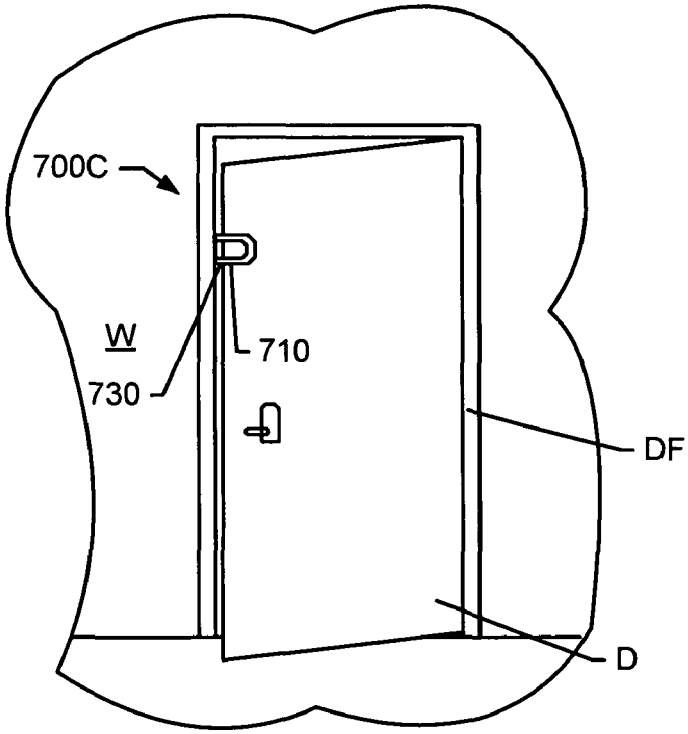
FIG. 7C illustrates the security latch device, in a door-ajaring operative position, installed on a hotel door and wall in accordance with some of the exemplary embodiments.

FIGS. 7A-7C illustrate a security latch device in a non-operative position, an operative position, and in a door-ajaring operative position, respectively. In FIGS. 7A and 7B, the hotel door D is shown closed and is viewed from the inside. The door frame DF includes right and left vertical jambs and top and bottom horizontal jambs. A door D is hingedly coupled to one of the vertical jambs. In FIG. 7C, the door is ajar and viewed from the outside. The reference label A, B or C after the number 700 is used to denote the different positions of the security latching arm 730 for the same security latch device (e.g., security latch device 300 or 500). The security latching arm 730 is capable of being moved, swung, pivoted or rotated to other intermediary positions between the positions shown in FIGS. 7A-7B, 7A and 7C or 7B and 7C. Thus, the positions are exemplary and not intended to be limiting. The security latching arm 730 is covered by security latching arm cover 710.

In FIGS. 7A-7C, the security latching arm 730 of U-shaped latching assembly 720 is shown mounted to the wall W adjacent to the door D. The ball hook assembly 740 is shown mounted to the door D. However, the locations of the U-shaped latching assembly 720 and the ball hook assembly 740 may be reversed such that the U-shaped latching assembly 720 is mounted to the door while the ball hook assembly 740 is mounted to the wall W.

In FIG. 7A the security latching arm 730 is shown pivoted or rotated away from the ball hook assembly 740 mounted to door D. Thus, the security latching arm 730 is in a non-operative position. In the non-operative position, the door can be open and closed by the occupant freely.

In FIG. 7B, the security latching arm 730 is shown in an operative position shown pivoted 180 degrees from the position shown in FIG. 7A. The operation position orients the slide channel over the ball hook assembly 740 which aligns the curved finger or prong member or portions thereof in the slide channel. If the door D is open, the ball hook assembly 740 locks or yokes with the security latching arm 730. The door D is permitted to open partially, as the curved finger or prong member slides in the slide channel.

FIG. 7C corresponds to the door-ajaring operative position. In the door-ajaring position, the security latching arm 730 is rotated, moved, swung or pivoted to that the arm 730 so that the security latching arm 730 is interposed between the door jamb and the door D. The security latching arm cover 710 installed on the arm 730 dampens or buffers impacts imparted to the arm 730 when the door D closes or slams into the security latching arm 730.

As can be readily seen, the security latch device 200A-200C, 300, 500 or 700A-700C with a security latching arm cover 100, 310, 510 or 710, respectively, prevents or minimizes damage to a door, door jamb or door frame from a strike, impact or shock imparted to the security latching arm from a closing door when the security latching arm (e.g., arm 10, 224, 330, 530, 730) is interposed or, otherwise, is positioned between the door and the door jamb or door frame. In addition, security latch device 200A-200C, 300, 500 or 700A-700C with a security latching arm cover 100, 310, 510 or 710, respectively, allows the door to stay partially open and helps in reducing the noise generated when the door slams into, hits or strikes a security latching arm interposed between the door and door jamb or door frame.

As can be readily seen, the security latching arm cover 100, 310, 510 or 710 may be used with existing security latch devices to prevent damage to a door, door jamb or door frame from a strike, impact or shock imparted to a security latching arm of an existing device from a closing door when the security latching arm is interposed or, otherwise, is positioned between the door and the door jamb or door frame. In addition, the security latching arm cover 100, 310, 510 or 710 when used with existing security latch devices allows the door to stay partially open and helps in reducing the noise generated when the door slams into, hits or strikes a security latching arm of the existing security latch device interposed between the door and door jamb or door frame.

Advantages of the security latching arm covers will now be described. An advantage of the security latching arm covers is that the covers can be installed on various latch configurations or conventional latches. Another advantage of the security latching arm covers is that the security latching arm covers protect a door, door jamb and/or door frame from damages which control maintenance cost. Resilient material or other material of the security latching arm cover serves to absorb the noise and shock produced during the use of the door. The security latching arm covers are constructed to bears the strain over, without restraining natural movement of the door. The covers are economical and easy to use.

The security latching arm covers described herein are constructed as a sleeve, sleeve portions or a coating that affixes or binds to a security latching arm, the security latching arm cover protecting the door, door jamb and/or door frame from damages that may occur due to repetitive hits by left open latches, the latches left between them.

Exemplary embodiments of the invention include a sleeve or coating that is able to be attached or affixed to retrofit existing security latch devices. The security latching arm cover may be "cushiony" sleeve so that when the security latching arm cover or sleeve is interposed between a door and door frame or door jamb, the strike on the jamb, the security latching arm and door the imparted by a closing door is dampened, buffered or absorbed. The security latching arm cover or sleeve prevents direct contact with the hard and rigid metal surfaces of the security latching arm.

The cushiony material of the security latching arm cover or sleeve may be made of a man-made product, natural product, synthetic product and combinations thereof. For example, the security latching arm cover or sleeve may be a rubber coating that is permanently fixed on the security latching arm.

According to exemplary embodiments, the security latching arm cover is a door protector, a door jamb protector, a door frame protector and a security latching arm protector. The security latch devices described herein are for used on hotel doors motel doors, residence doors, etc. where a security latch device is used. These security latch devices and the latching arms associated therewith may have different physical configurations and the invention envisions accommodating these various configurations, including U-shaped designs, sling designs, retainer designs, designs having a "ball" shaped end and others configurations and designs.

According to some of the embodiments, an security latching arm of the security latch device includes a cover, sliding attachment, coating, or other materials affixed thereto to protect a door (e.g., hotel door) from damage incurred when the latching arm is used to prop open the door—that is, to prevent the door from securely closing. According to some of the exemplary embodiments, the inventive construction includes a rubber sleeve that is inserted over the elongated latching arm of the bar-type security latch devices. Alternate embodiments include the sleeve made of natural and/or man-made materials.

A transparent latching arm cover renders the cover essentially invisible or obscure. Thus, the addition of the cover is barely detectable. The cover does not aesthetically distract in a hotel or motel environment. The security latching arm cover is not visible from the hall of a hotel when the door is closed—that is, the sleeve is only visible when the security latching arm is used to prop open the door.

Other advantages of the security latching arm cover is beneficial to hotel owner's by protecting the door and by reducing a need for maintenance and/or replacement of the door due to paint chipping, denting or other damage from the security latching arm.

The door protector is equally applicable in different kinds of latches, retaining systems, sliding bolts and chain latches or convex type locking systems.

Although the exemplary embodiments of the door protector are preferred and aimed for use in protecting the door and/or the door frame from damages that occur due to open locking devices, the same is equally helpful and applicable in sliding bolts and all kinds of latches, while using the protecting head of the locking to prop open a door or to otherwise cause interference.

While the present invention has been described with respect to various features, aspects, and embodiments, those skilled and unskilled in the art will recognize the invention is not so limited. Other variations, modifications, and alternative embodiments may be made without departing from the spirit and scope of the present invention.

What is claimed is:

1. A door security device comprising:

a hook assembly configured to be mounted to a door;

a base configured to be mounted to a door frame;

a security latching arm pivotally mounted to the base, the arm consisted of two parallel legs connected at an apex portion creating a U-shape and a protruding member extending from the apex, wherein, the security latching arm is configured to be positioned on a non-operative position, away from a door moving path and allowing the door to move along the path, an operative position, wherein the arm is engaged to the hook assembly to prevent further movement of the door, and a door ajaring position, wherein the arm is not attached to the hook assembly and is on the door moving path;

a U-shaped sleeve configured to conform to the shape of the security latching arm, made of impact absorbing material such that the sleeve prevents damage to an impacted surface when the surface impacts the latching arm, the sleeve having a notch portion to receive and pass therethrough the protruding member.

2. The device of claim 1, wherein the sleeve comprises a slit formed longitudinally along a length of the sleeve to create an openable seam to install the sleeve over and around the security latching arm.

3. The device of claim 1, wherein the protruding member comprises a ball.

4. The device of claim 1, wherein the impact absorbing material comprises at least one of:

sponge rubber, rubber, resilient and flexible plastic material, leather, foam rubber, natural impact absorbing material; and man-made impact absorbing materials.

5. The device of claim 1, wherein the impact absorbing material comprises a material that is painted, sprayed or coated onto a portion of the security latching arm.

6. The device of claim 1, wherein the impacted surface comprises an edge, surface or paint of a door or door frame.

7. The device of claim 1, wherein the impacted surface comprises an edge, surface or paint of a door frame or door jamb.

* * * * *